United States Patent [19]

Kranz

[11] Patent Number: 4,646,991

[45] Date of Patent: Mar. 3, 1987

[54] CONTROLLABLE FLOW DEFLECTION SYSTEM

[75] Inventor: Walter Kranz, Taufkirchen, Fed. Rep. of Germany

[73] Assignee: Messerschmitt-Bolköw-Blohm GmbH, Munich, Fed. Rep. of Germany

[21] Appl. No.: 647,983

[22] Filed: Sep. 6, 1984

[30] Foreign Application Priority Data

Sep. 8, 1983 [DE] Fed. Rep. of Germany ..... 3332415

[51] Int. Cl.[4] ..... F42B 15/033

[52] U.S. Cl. ..... 244/3.22

[58] Field of Search ..... 244/3.22; 239/265.15, 239/265.25, 265.27, 265.33, 504, 505, 518, 521

[56] References Cited

U.S. PATENT DOCUMENTS

| | | | |
|---|---|---|---|
| 2,995,894 | 8/1961 | Baxter et al. | 244/3.22 |
| 3,273,825 | 9/1966 | Kerner | 244/3.22 |
| 4,463,921 | 8/1984 | Metz | 244/3.22 |
| 4,482,107 | 11/1984 | Metz | 244/3.22 |
| 4,522,357 | 6/1985 | Bains et al. | 244/3.22 |

FOREIGN PATENT DOCUMENTS

| | | | |
|---|---|---|---|
| 63979 | 11/1982 | European Pat. Off. . | |
| 68972 | 1/1983 | European Pat. Off. . | |
| 69442 | 1/1983 | European Pat. Off. . | |
| 84/02975 | 8/1984 | PCT Int'l Appl. | 244/3.22 |
| 998417 | 7/1965 | United Kingdom . | |
| 1056076 | 1/1967 | United Kingdom . | |

*Primary Examiner*—Charles T. Jordan

*Attorney, Agent, or Firm*—Toren, McGeady and Goldberg

[57] ABSTRACT

A controllable flow deflection system for guiding the flow of a fluid medium in a desired discharge direction includes a steered deflection device mounted in a body or support member. The deflecting device includes a rotatable element containing at least one outlet opening for discharging the fluid medium which flows to the element from a reservoir. A driving and braking device is connected to the rotatable element. The one or more outlet openings are arranged so that the discharged fluid medium does not cause any torque on the rotatable element, or a torque is developed from a combination of two torque vectors symmetrical with respect to the axis of rotation of the element. Such a system may be used in a thrust system for steering a flying body member, in a secondary injection system, or in a hot gas motor, such as a vane motor.

16 Claims, 11 Drawing Figures

CONTROLLABLE FLOW DEFLECTION SYSTEM

SUMMARY OF THE INVENTION

The present invention is directed to a controllable flow deflection system for guiding a fluid medium in a desired discharge direction including a steered deflecting device arranged to receive and to guide the outlet flow of the fluid medium.

Such a controllable fluid flow deflection system is used direct the flow of a fluid medium from a reservoir into a desired flow direction. In the applicant's co-pending application No. P 33 17 583.7 filed in the Federal Republic of Germany a quick switching, controllable flow deflection system is disclosed including a rotatable nozzle driven by the flow medium so that the nozzle is stopped when the thrust jet flowing from the nozzle is in the desired discharge direction.

Therefore, the primary object of the present invention is to provide a flow deflection system of the above type constructed in a simple manner and capable of simple control of the deflection device.

In accordance with the present invention, the deflecting device includes a rotatable element with at least one outlet opening for the fluid medium. A driving and braking device is connected to the rotatable element for rotating it selectively and stopping it in a desired position for the directed outflow of the fluid medium.

A simple rotary element with at least one discharge or outlet opening forms the deflection device and the outlet opening can be positioned by a driving and braking device whereby the fluid medium is directed in the desired outflow direction. The outflow opening extends in the radial direction relative to the axis of rotation of the rotatable element so that the outflow of the fluid medium exercises no torque on the rotatable element. It is advantageous when using plural discharge openings to locate them in a radial plane of the rotatable element on opposite sides of the axis of rotation and at the same distance from the axis of rotation so that two sources of torque are provided each acting in an opposite direction and with the same strength. In either arrangement, during braking of the rotatable element, it is possible to assure that no forces occur which are asymmetrical relative to the axis of rotation of the rotatable element. Accordingly, the braking device may be of a very simple construction.

By separating the drive of the rotary element and the flow deflection, the two devices can be operated independently of one another, for instance, they can be actuated independently of one another. As an example, if the flow is deflected into the desired outflow direction, the drive can be cut off. On the other hand, if during the driving operation no flow is necessary, then the flow may be interrupted, for instance, by rotating the outlet opening into position where it is sealed by a cover. It is possible, of course, to drive the rotatable element using the flow of the fluid medium itself or at least to support the drive with the flow of the fluid medium. It is possible in the region of the outlet openings from the rotatable element to provide deflecting surfaces arranged so that a driving torque is effected by the fluid medium on the rotatable element. In place of separate deflecting surfaces, it is possible to shape the path of the outlet opening or ducts which convey the fluid medium and which are connected with the reservoir for the fluid medium.

In a preferred embodiment of the invention, the drive for the rotatable element is provided on the axis of rotation of the element. For such a drive, spring activation, an electric motor, a wind wheel drive or a combination of the wind wheel drive and spring activation can be utilized. It is also possible to provide other combinations for the drive. By using such drives directly on the axis of the rotatable element, dynamic imbalances are prevented.

The drive for the rotatable element and the brake may be separate structural members or they may be combined in a common unit. The drive may be constructed as a switching mechanism. Further, a reversible drive is also advantageous.

With a flow deflection system according to the present invention, it is possible to provide the rotatable element as a deflecting device rotating practically without any imbalances. As a result, the stresses acting on the rotatable element can be significantly reduced. In this flow deflection system, the energy acts directly in the discharge or outflow direction which can be aligned as desired.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
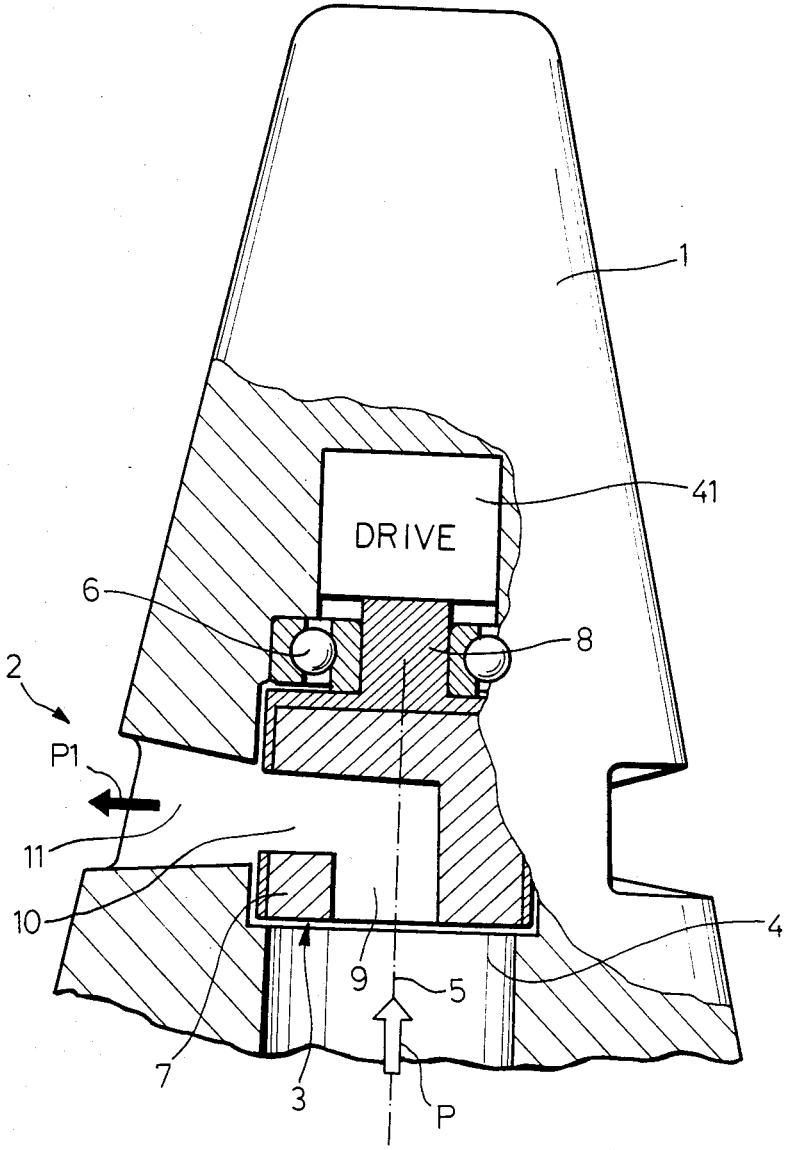
FIG. 1 is a partial view through the tip of a projectile incorporating a flow deflection system, in accordance with the present invention, for steering the projectile.

In FIG. 1 the tip of a projectile or missile 1 is illustrated, partly in section, and it is equipped with a flow deflection system 2 for steering the missile. The deflection system includes a rotatable element 3 supported in a central bore 4 formed in the missile or body member 1. The element 3 is rotatable about the long axis 5 of the missile. At its upper end, as viewed in FIG. 1, the rotatable element 3 is clamped in ball bearing arrangement 6. The lower portion of the rotatable element is a cylindrical part 7 with a diameter roughly the same as the inside diameter of the central bore 4. A neck portion 8 extends upwardly from the cylindrical part 7 and it is located within the ball bearing arrangement 6. In the cylindrical part 7, a bore 9 is provided aligned with the axis 5 of the central bore 4, and intermediate the ends of the cylindrical part, the bore 9 changes direction and continues as a bore 10 extending radially outwardly from the axis 5 and serving as an outlet opening for a fluid medium supplied through the bore 4 to the bores 9, 10. Fluid medium is supplied from a reservoir, not shown, such as a gas generator, in flow communication with the central bore or duct 4. The flow direction of the fluid medium within the bore 4 is identified with P while the outflow direction of the fluid medium from the rotatable element is identified with P1. The wall of the missile 1 contains several outflow ports 11 leading to the outside lateral periphery of the missile. When the outlet opening 10 is in flow communication with one of the outflow ports 11, then the gas jet supplied through the bore 4 to the rotatable element is deflected outwardly first passing in the direction of the bore 9 and then through the bore 10 along a path extending substantially perpendicularly of the path through the bore 9. From the outlet opening 10 the fluid medium continues its flow through the outflow port 11 in the direction indicated by the arrow P1. As a result, a transverse thrust acts on the missile 1 for steering it.

Figure 1A:
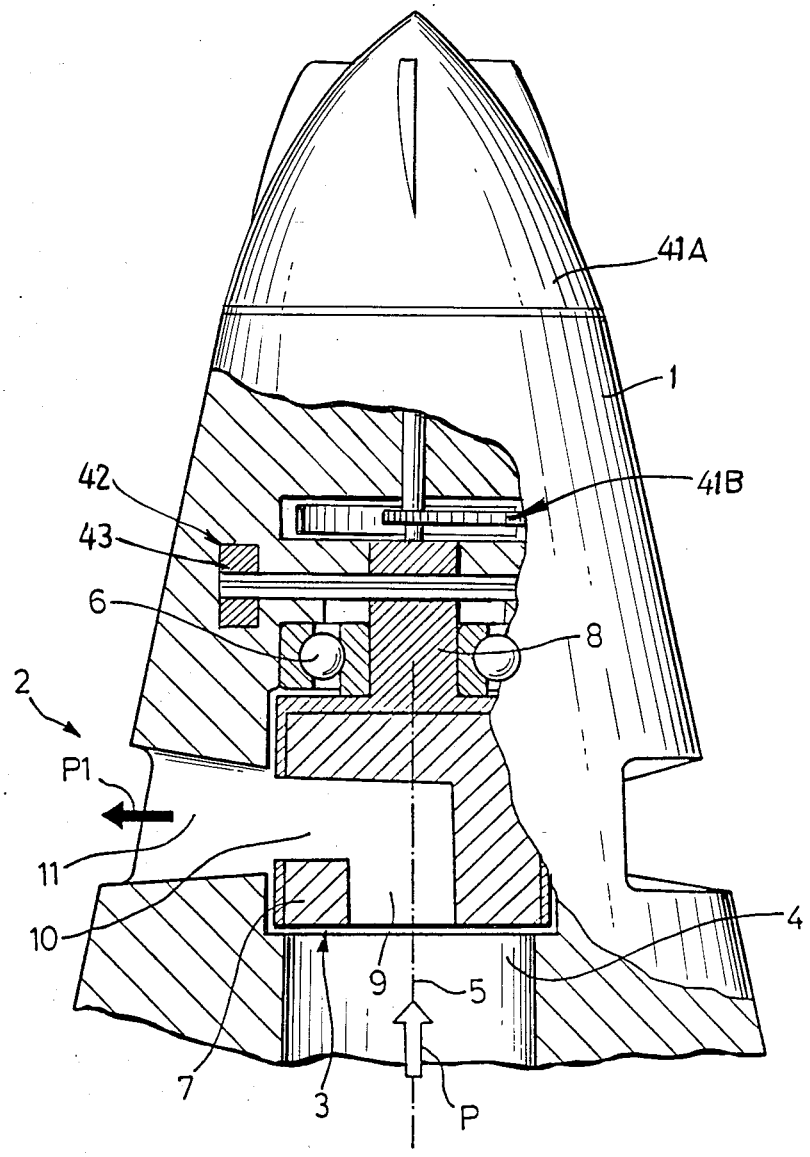
FIG. 1A is a partial view, similar to FIG. 1, illustrating detail features of the present invention.
Figure 1B:
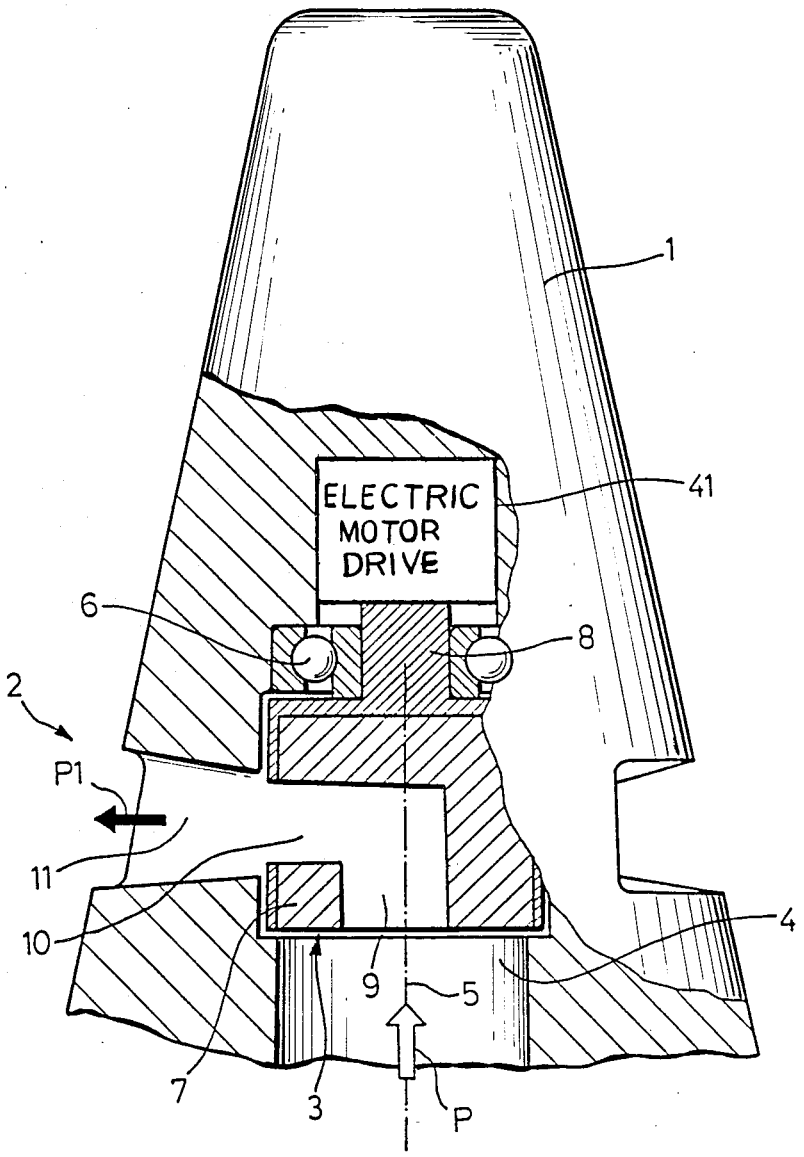
FIGS. 1B–1E are partial views, similar to FIG. 1 displaying schematically various drives.
Figure 1C:
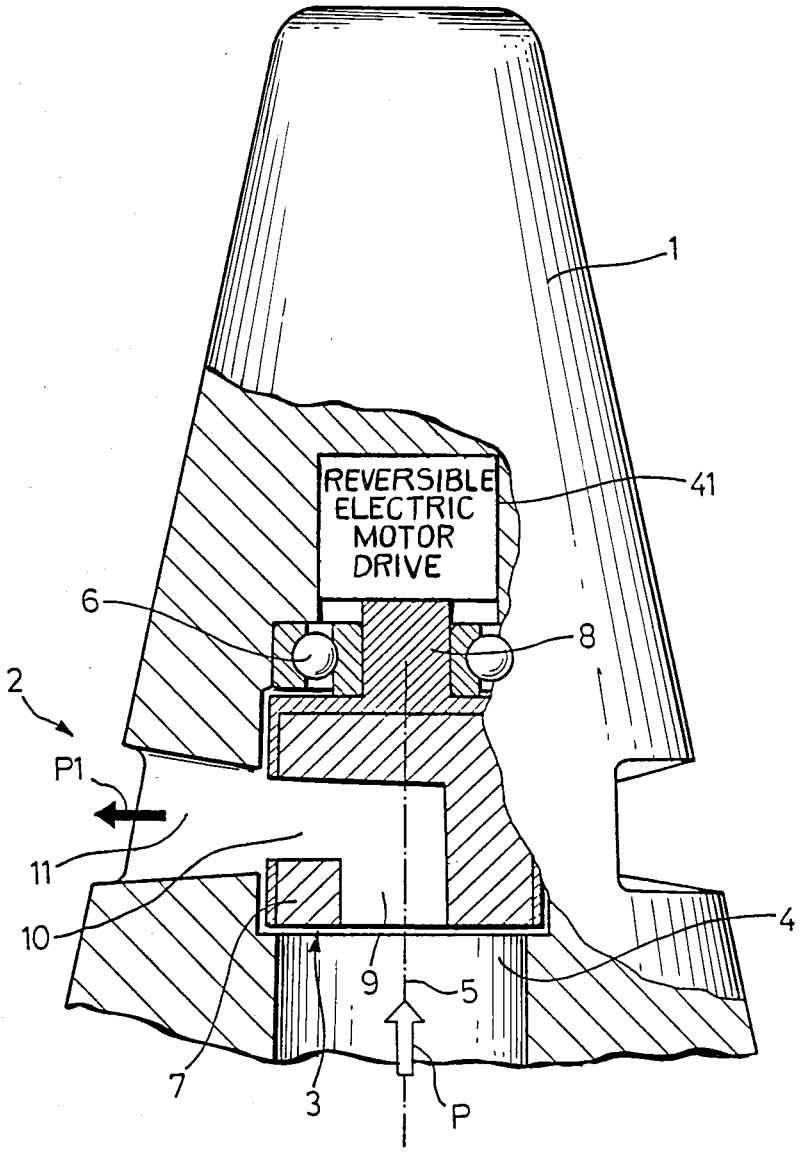
Figure 1D:
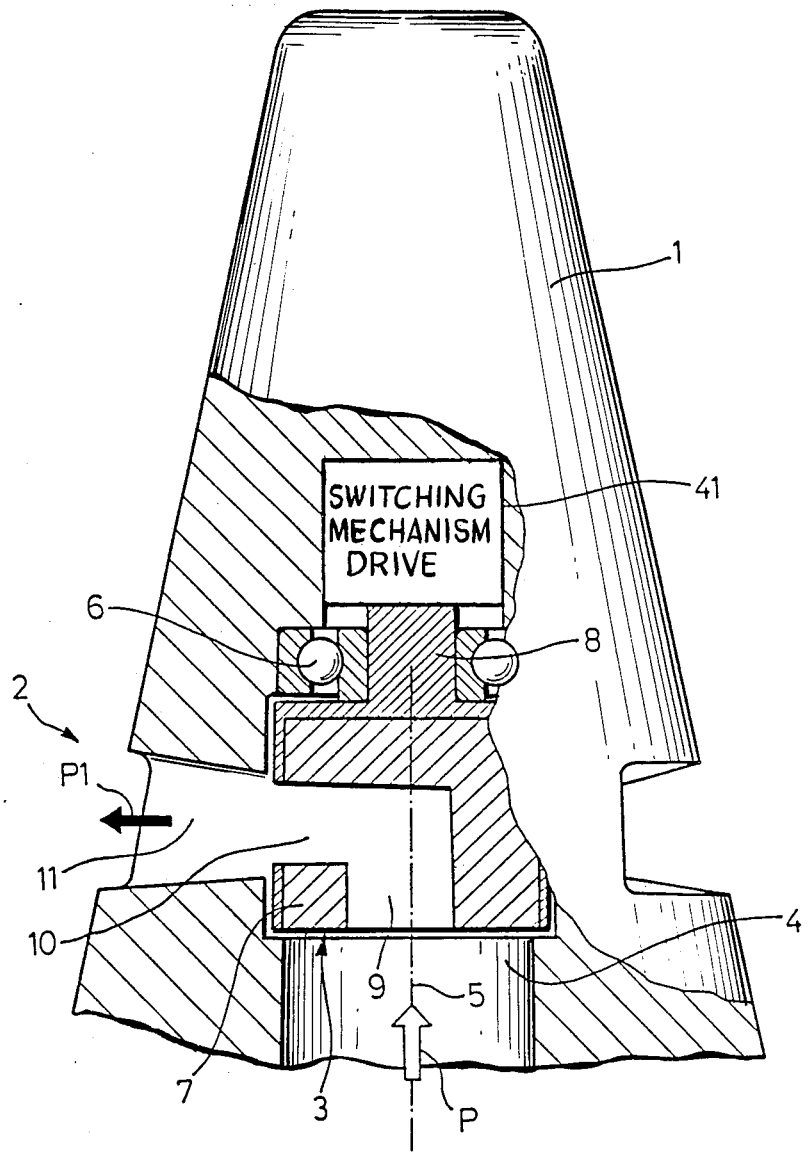
Figure 1E:
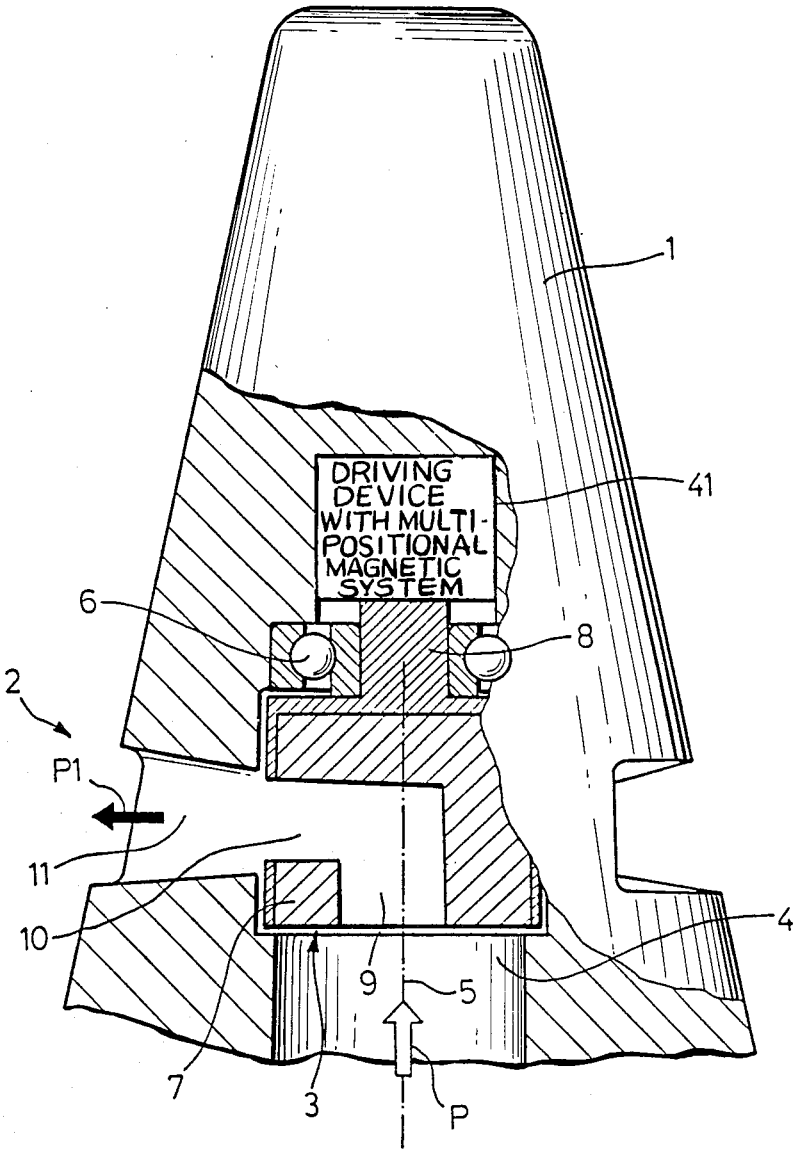

Within the missile 1 above the neck portion 8 of the rotatable element, a drive 41 is connected to the element so that it can be placed in rotation about the axis 5. The drive 41 can be an electric motor, note FIG. 1B. The electric motor can be reversible, note FIG. 1C. The drive can also be a switching mechanism, note FIG. 1D. Further, as set forth in FIG. 1E, the drive can include at least one magnetic system with several positions. A braking device 42, note FIG. 1A, is connected with the drive and may be in the form of a friction clutch 43. Moreover, the drive may be a switching mechanism. The rotatable element 3 is rotated by the drive 41 until its outlet opening is directed in the desired outflow direction. With the outlet opening 10 of the element 3 oriented in the desired outflow direction, the rotatable element is held by the braking device.

The drive 41 can be a windwheel drive as shown in FIG. 1A. The windwheel 41A drives a spring actuation spring drive 41B connected to the rotatable element 3.

Figure 2:
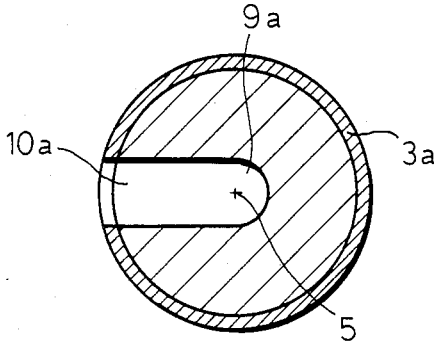
FIGS. 2–4 each show a schematic cross-section of a rotary element in a flow deflection system embodying the present invention.

As illustrated in FIG. 2, the outlet opening **10*a* from the rotatable element 3*a* extends radially relative to the axis of rotation 5. The bore 9*a* in the rotatable element 3*a* is coaxial with the axis of rotation 5 while the outlet opening 10*a* extends transversely of the bore 9*a***.

Figure 3:
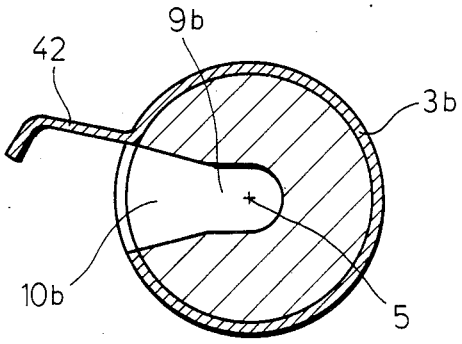

As displayed in FIG. 3, the outlet opening **10*b* extends radially outwardly from the axis of rotation 5, however, it has the shape of a nozzle which diverges outwardly from the bore 9*b* coaxial with the axis of rotation. At the outlet end of the nozzle-shaped opening 10*b*, a deflecting surface 42 extends outwardly from the rotatable element with the outer end projecting into the outflow path from the opening 10*b* so that the fluid medium flow is deflected out of the radial direction. This deflecting surface 42 may serve to rotate the rotatable element 3*b* so that a separate drive for the element is unnecessary, or it may serve to support the drive 41** for the rotatable element so that a faster start can be provided after the braking action.

Figure 4:
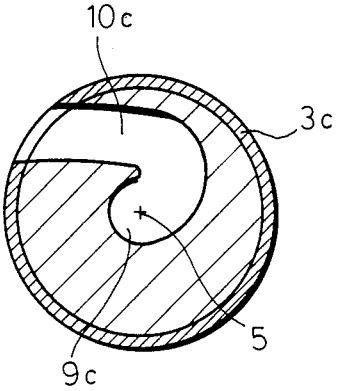

In FIG. 4, the rotatable element **3*c* has a centrally located bore 9*c* coaxial with the axis of rotation and the outlet opening 10*c* initially extends in a radial plane from the bore 9*c* and then follows a curved path extending to the outer peripheral surface of the element. As a result, the outflow of the fluid medium passing from the central bore 9*c* flows first radially outwardly from the axis of rotation and then along an eccentric path relative to the axis. With the curved path of the outlet opening 10*c*, similar to the embodiment shown in FIG. 3**, the arrangement of the outlet opening serves to rotate the rotatable element or to support the drive of the rotatable element during start up.

Figure 5:
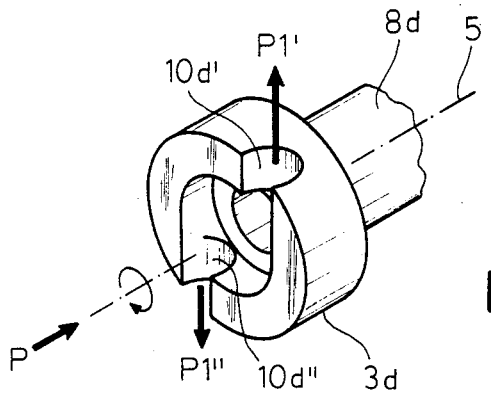
FIGS. 5 and 6 are each perspective views of a portion of the rotatable element in a flow deflection system according to the present invention.

In FIG. 5 a partial perspective view of a rotatable element **3*d* is set forth. The rotatable element has two oppositely directed outlet openings 10*d*′ and 10*d*″ each of which is located in a radial plane and is spaced the same distance from the axis of rotation, however, they are located on opposite sides of the axis of rotation and are oppositely directed with respect to the outflow directions, note the arrows P1′ and P1″. Initially, the fluid medium flows along the axis of rotation corresponding to the arrow P centrally into the rotatable element 3*d* and then changes direction and flows out through the outlet openings 10*d*′ and 10*d*″ in the directions indicated by the arrows P1′ and P1″. The rotatable element 3*d* can be connected with a drive by the neck portion 8*d*. In the illustrated embodiment, two oppositely directed torques, symmetrical to the axis of rotation 5, act on the rotatable element 3*d* so that circular rotation is imparted to the elements without any imbalance. As in the embodiments shown in FIGS. 3 and 4**, the forces acting on the rotatable element can be used either to drive the rotatable element or to support the action of the separate drive.

Figure 6:
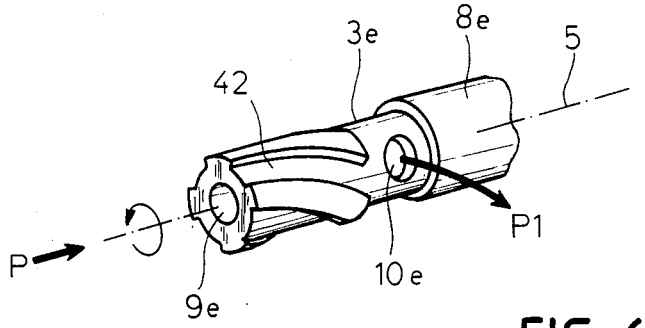

In FIG. 6 another rotatable element **3*e* is exhibited and the element has an elongated bore 9*e* coaxial with the axis of rotation 5 and the bore 9*e* continues into a radial outlet opening 10*e* so that the fluid medium flowing through the rotatable element 3*e* passes in the direction of the arrow P1. On the outer circumferential periphery of the rotatable element 3*e*, helical ducts 42 are formed through which the fluid medium P flows and the fluid medium is supplied from a reservoir, not shown, passing along the axis of rotation 5. The fluid medium flowing through the helical ducts 42 rotates the rotary rotatable element 3*e* and, in turn, drives the rotatable element 3*e* or provides support during start up for the drive, not shown, connected with the neck portion 8*e***.

The bore 9 or several such bores 9, if the support conditions require it, extend parallel to the axis of rotation 5.

The flow deflection system has a multitude of uses. In addition to the described use of the flow deflection system in the thrust system of a flying body, it can also be used as a secondary injection system, or in a hot gas motor, such as a vane motor, as explained in detail in the above-mentioned application No. P 33 17 583.7.

As the fluid medium, the gas from a gas generator or a driving mechanism can be used or a liquid or compressed air can be employed.

While specific embodiments of the invention have been shown and described in detail to illustrate the application of the inventive principles, it will be understood that the invention may be embodied otherwise without departing from such principles.

I claim:

1. A controllable flow deflection system for guiding a fluid medium in a desired outlet direction, comprising a steered deflecting device arranged to receive and to guide the direction of flow of the fluid medium, said deflecting device includes a rotatable element having an axis of rotation, said rotatable element having at least one outlet opening for the fluid medium, a driving and braking device connected to said rotatable element for selectively rotating said element and stopping said element in a desired position for directing flow of the fluid medium out of said at least one outlet opening, said outlet opening affords a radially directed flow out of said rotatable element, and a deflecting surface positioned on the outer periphery of said rotatable element adjacent said outlet opening for intercepting the radially directed flow of the fluid medium out of the outlet opening and displacing it from the radial direction.

2. A controllable flow deflection system, as set forth in claim 1, wherein said deflecting surface is positioned in the path of the fluid medium flowing out of said outlet opening for effecting a driving torque on said rotatable element.

3. A controllable flow deflection system for guiding a fluid medium in a desired outlet direction, comprising a steered deflecting device arranged to receive and to guide the direction of flow of the fluid medium, said deflecting device includes a rotatable element having an axis of rotation, said rotatable element having at least one outlet opening for the fluid medium, a driving and braking device connected to said rotatable element for selectively rotating said element and stopping said element in a desired position for directing flow of the fluid medium out of said at least one outlet opening, and said outlet opening is arranged to drive said rotatable element about the axis of rotation.

4. A controllable flow deflection system, as set forth in claim 1 or 3, wherein said rotatable element has an inlet bore coaxial with the axis of rotation of said rotatable element and connected to said outlet opening with said outlet opening extending transversely of the axis of rotation.

5. A controllable flow deflection system, as set forth in claim 4, wherein plural outlet openings are provided in said rotatable element spaced angularly apart about the axis of rotation of said rotatable element and arranged relative to one another so that no torque acts as a result of the flow of the fluid medium through said outlet openings.

6. A controllable flow deflection system, as set forth in claim 5, wherein said outlet openings are arranged in the radial direction with respect to the axis of rotation of said rotatable element.

7. A controllable flow deflection system, as set forth in claim 4, wherein plural said outlet openings are located in said rotatable element spaced angularly apart about the axis of rotation of said rotatable element and said outlet openings are arranged on opposite sides of the axis of rotation so that the rotatable element is rotated about the axis of rotation without any imbalance.

8. A controllable flow deflection system, as set forth in claim 7, wherein a pair of said outlet openings are arranged in a radial plane of said rotatable element on opposite sides of the axis of rotation thereof and at the same distance from the axis of rotation affording oppositely directed flow of the fluid medium out of said rotatable element.

9. A controllable flow deflection system, as set forth in claim 4, wherein spring activation means are provided in said driving device for effecting the rotation of said rotatable element.

10. A controllable flow deflection system, as set forth in claim 4, wherein said driving device for said rotatable element is an electric motor.

11. A controllable flow deflection system, as set forth in claim 4, wherein said driving device for said rotatable element is a wind wheel drive.

12. A controllable flow deflection system, as set forth in claim 4, wherein said driving device is arranged for reversing the direction of rotation of said rotatable element about the axis of rotation.

13. A controllable flow deflection system, as set forth in claim 12, wherein said driving device is a reversible electric motor.

14. A controllable flow deflection system, as set forth in claim 4, wherein said driving device is a switching mechanism.

15. A controllable flow deflection system, as set forth in claim 14, wherein said driving device includes at least one magnetic system with several positions.

16. A controllable flow deflection system for guiding a fluid medium in a desired outlet direction, comprising a steered deflecting device arranged to receive and to guide the direction of the fluid medium, said deflecting device includes a rotatable element having an axis of rotation, said rotatable element having at least one outlet opening for the fluid medium, a driving and braking device connected to said rotatable element for selectively rotating said element and stopping said element in a desired position for directing flow of the fluid medium out of said at least one outlet opening, said rotatable element has an inlet bore coaxial with the axis of rotation of said rotatable element, said rotatable element has an axially extending section located upstream in the direction of flow of the fluid medium from said outlet opening and laterally enclosing said inlet bore, said axially extending section has a radially outer surface with generally axially extending helically ducts formed into said radially outer surface whereby the fluid medium can be directed through said helical ducts for rotating said rotatable element.

* * * * *